US007770527B2

(12) United States Patent
Hand

(10) Patent No.: US 7,770,527 B2
(45) Date of Patent: Aug. 10, 2010

(54) BLUEPRINT DISPLAY TABLE

(75) Inventor: Edward M. Hand, Boca Raton, FL (US)

(73) Assignee: K.E. Sales, Inc., Boca Raton, FL (US)

( * ) Notice: Subject to any disclaimer, the term of this patent is extended or adjusted under 35 U.S.C. 154(b) by 1115 days.

(21) Appl. No.: 10/844,176

(22) Filed: May 12, 2004

(65) Prior Publication Data

US 2005/0252427 A1 Nov. 17, 2005

(51) Int. Cl.
*A47B 3/00* (2006.01)

(52) U.S. Cl. ..... 108/115

(58) Field of Classification Search ..... 108/115, 108/121, 123, 125, 129, 130, 131, 151, 160
See application file for complete search history.

(56) References Cited

U.S. PATENT DOCUMENTS 1,568,167 A 1/1926 Kunkle
D123,806 S 12/1940 Griese
3,124,085 A * 3/1964 Sanchez ..... 108/115
D212,623 S 11/1968 Rubenstein
3,805,710 A * 4/1974 Leshem ..... 108/6
D234,662 S 4/1975 Stiene
4,533,179 A * 8/1985 Nichols et al. ..... 297/440.12
6,041,723 A * 3/2000 Peterson ..... 108/115
6,314,892 B1 * 11/2001 Favini ..... 108/115
6,431,091 B1 * 8/2002 Chang ..... 108/115
D467,100 S * 12/2002 Hand ..... D6/485

* cited by examiner

*Primary Examiner*—Janet M Wilkens
(74) *Attorney, Agent, or Firm*—Miller Canfield Paddock & Stone

(57) ABSTRACT

A display table movable between a standing position and a folded position is disclosed, comprising a back, a table top pivotable with respect to the back, a middle leg pivotable with respect to the back, and a brace pivotable with respect to the back and slidably received in the middle leg. In the standing position the brace engages the middle leg so as to resist movement of the middle leg with respect to the brace.

3 Claims, 4 Drawing Sheets

BLUEPRINT DISPLAY TABLE

FIELD OF THE INVENTION

This invention relates to improvements in tables, and more particularly to improvements in tables used in display of documents, including blueprints.

BACKGROUND OF THE INVENTION

Display tables for displaying documents, such as blueprints, are useful in a wide variety of applications including, for example construction sites where a supervisor or an inspector may want to set down drawings or blueprints to compare with the construction underway. At such construction sites, display tables should be light weight, portable and weight resistant. They should also have the ability to hold down documents and should be readily adaptable to all sorts of uneven surfaces. Further, given the ever changing needs of construction sites, such tables should be easy to move, assemble, disassemble and move again.

U.S. Design Pat. No. D467,100 to Hand discloses a blueprint display table adapted for use on construction sites. A back has a pair of back legs, a middle leg is pivotably mounted on the back and a top pivotably mounted on the back. Such a table is advantageous for individuals working at construction sites who might otherwise have to read blueprint plans and other documents off the ground. It would be highly desirable to have an improved, low cost, easy to assemble and position display table which is also sturdy, portable, weather resistant and easy to manufacture.

SUMMARY OF THE INVENTION

In accordance with a first aspect, a display table is movable between a standing position and a folded position and comprises a back, a table top pivotable with respect to the back, a middle leg pivotable with respect to the back, and a brace pivotable with respect to the back and slidably received in the middle leg. In the standing position the brace engages the middle leg so as to resist relative movement of various components of the display table. In accordance with another aspect, the table top has projections which define a channel and at the standing position the middle leg is positioned in the channel and the projections resist movement of the middle leg. In accordance with another aspect, the middle leg, brace and table top pivot against the back when in the folded position.

From the foregoing disclosure and the following more detailed description of various preferred embodiments it will be apparent to those skilled in the art that the present invention provides a significant advance in the technology of display tables. Particularly significant in this regard is the potential the invention affords for providing a high quality, low cost document display table. Additional features and advantages of various preferred embodiments will be better understood in view of the detailed description provided below.

Figure 1:
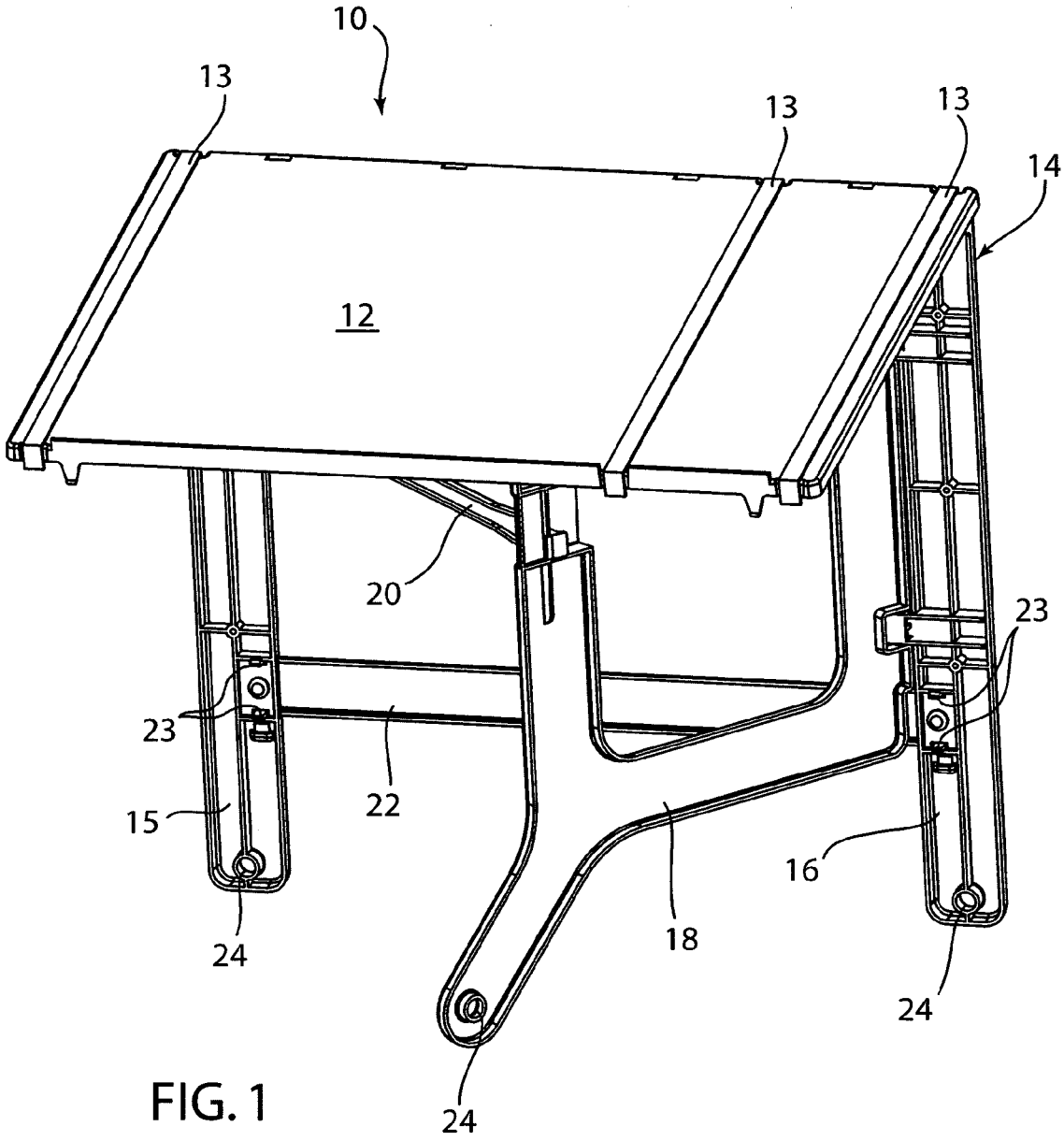
FIG. 1 is a perspective view of a display table in accordance with a preferred embodiment, shown in a standing position.

It should be understood that the appended drawings are not necessarily to scale, presenting a somewhat simplified representation of various preferred features illustrative of the basic principles of the invention. The specific design features of the table as disclosed here, including, for example, the specific dimensions of the brace, brace rise and brace slot, will be determined in part by the particular intended application and use environment. Certain features of the illustrated embodiments have been enlarged or distorted relative to others to enhance visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the display table disclosed here. The following detailed discussion of various alternative and preferred features and embodiments will illustrate the general principles of the invention with reference to a table particularly suitable for use display documents such as blueprints. Other embodiments suitable for other applications will be apparent to those skilled in the art given the benefit of this disclosure.

Referring now to the drawings, FIG. 1 shows a display table 10 in accordance with a preferred embodiment, shown in a standing position. A back 14 has a left back leg 15 and a right back leg 16 (as seen in the view in FIG. 1). A middle leg 18 is pivotably mounted on the right back leg 16, and a brace 20 is pivotably mounted on the left back leg 15. A cross beam 22 connects the left leg to the right leg. Preferably the cross beam has resiliently deformable projections 23 which engage the corresponding legs 15, 16 in a snap fit connection, greatly simplifying assembly of the cross beam to the back. A table top 12 is pivotably mounted on the top 99 (shown in FIGS. 3 and 5) of the back 14 and has a series of grooves which receive straps 13, preferably made of an elastic material. The straps would be used to mount and hold documents such as blueprints. Preferably the back 14, middle leg 18, table top 12, brace 20 and cross beam 22 are all formed from an injection moldable material, such as a thermoset plastic. Optionally holes 24 may be formed in the left and right back legs 15, 16 and the middle leg 18. The holes are sized to receive optional weights to hold the display table down. Such weights could comprise rebar, (reinforced bar steel), often found at construction sites.

Figure 2:
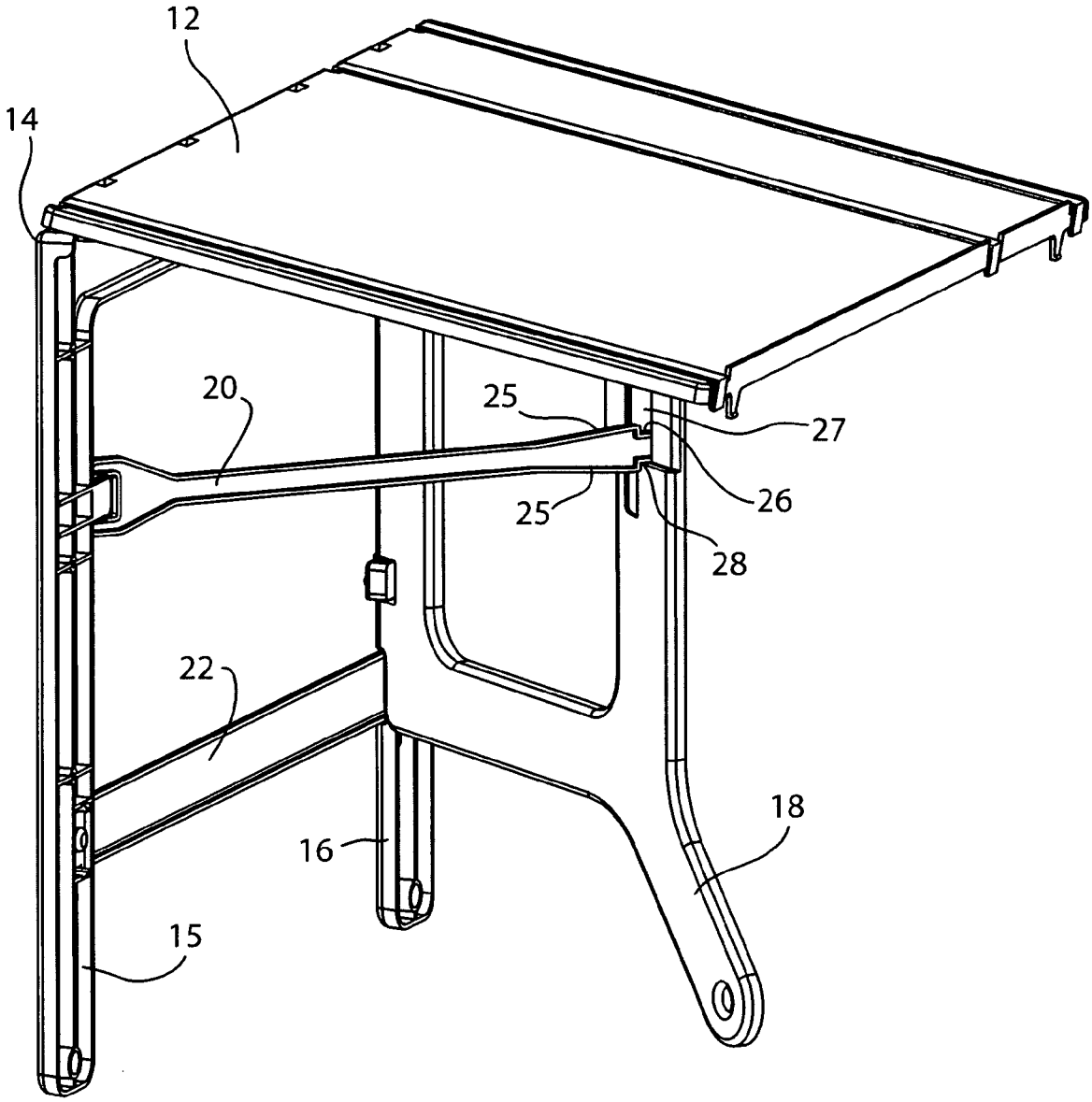
FIG. 2 is another perspective view of the display table of FIG. 1, shown in the standing position.

FIG. 2 shows the display table in the standing position but from a perspective showing the brace 20. The brace is seen to slidably mounted in an opening 27 in the middle leg 18. Preferably movement of the middle leg 18 and the brace 20 into the standing position is accompanied by a tactile sensation. A tactile sensation is understood here to mean a change in status which can be sensed by a user of the display table, and can include a snap fit connection. In the preferred embodiment shown in the drawings, the brace 20 is deflected slightly as the middle leg 18 slides over the rise 25. Once the middle leg reaches the notch 26, the brace 20 drops down into engagement with the ledge 28 at the bottom of the opening 27. Other ways of connecting the brace to the middle leg will be readily apparent to those skilled in the art given the benefit of this disclosure.

Figure 5:
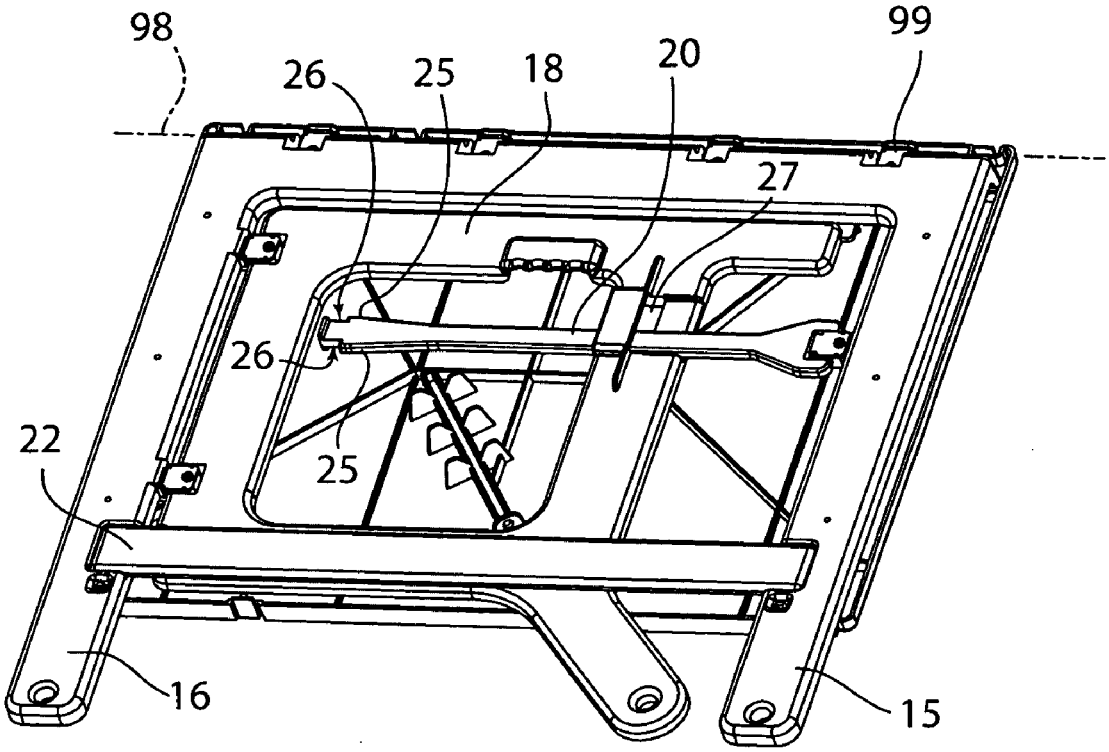

In accordance with a highly advantageous feature, the brace 20 is formed symmetrically, with a top rise 25 and top notch 26 extending oppositely from and generally identical to a bottom rise 25 and bottom notch 26 (as shown in FIG. 5). Such a symmetrical brace simplifies assembly and reduces the possibility for errors.

Figure 3:
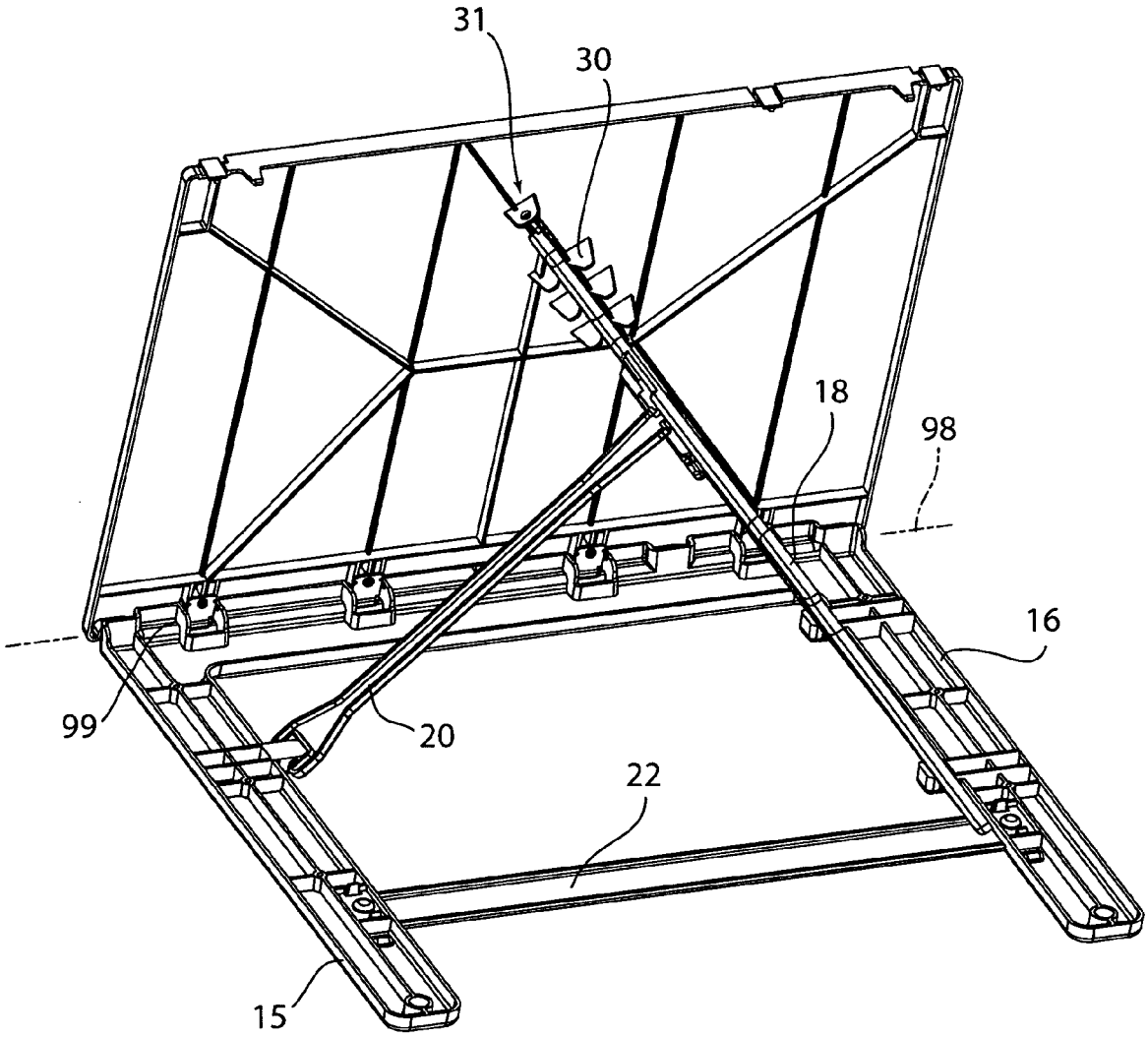
FIG. 3 is a perspective view of the underside of the table top, shown in the standing position.
Figure 4:
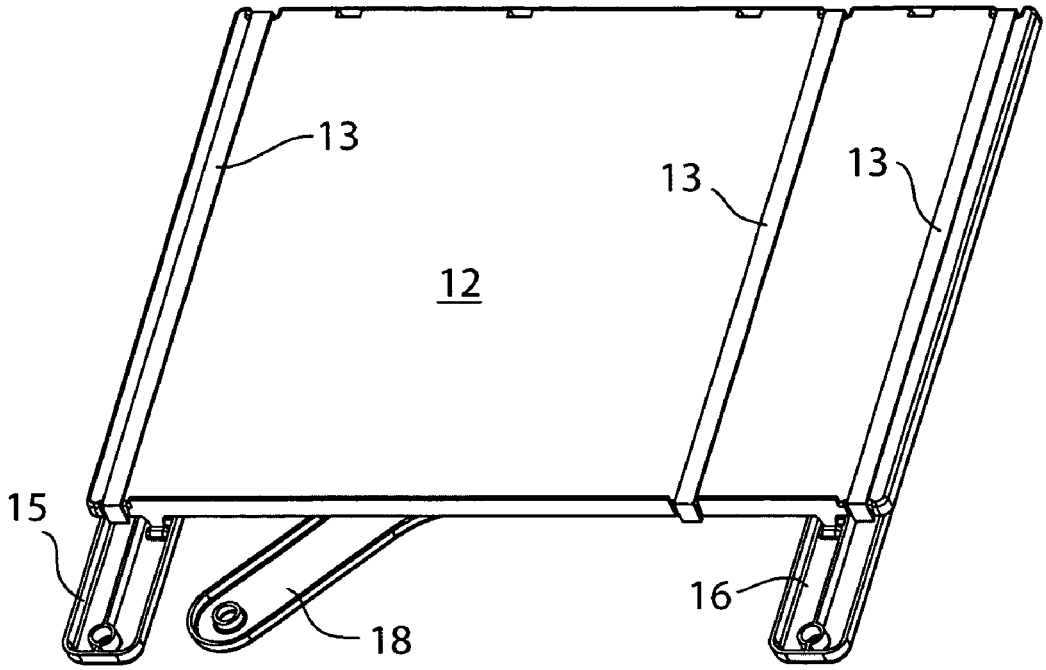
FIGS. 4 and 5 are front and back perspective views of the display table shown in the folded position.

The table top 12 is mounted near the top 99 of the back 14 and is pivotable about a first axis 98 from the standing position shown in FIG. 3 to the folded position shown in FIGS. 4 and 5. As shown in the drawings, the middle leg 18 is pivotable about the right back leg 16 and the brace 20 is pivotable about the left back leg 15. Preferably both the middle leg 18 and the brace pivot about axes that are generally perpendicular to the first axis 98.

FIG. 3 shows the underside of the table top 12. In accordance with a highly advantageous feature, the underside of the table top 12 is provided with a series of projections 30 which define a channel 31. As shown in the drawings, 6 projections are used. It will be readily apparent to those skilled in the art, given the benefit of this disclosure, that other formations, geometries and numbers of formations may be used to define a channel. The channel 31 receives the middle leg 18 when in the standing position to restrict movement of the middle leg with respect to the table top. In this manner the projections 30 and channel 31 cooperate with the rise 25 and notch 26 of the brace 20 to releasably hold the middle leg in the standing position. To move the table from the standing position to the folded position shown in FIGS. 4 and 5, the table top 12 is lifted up and the brace can be moved out of engagement with the bottom ledge 28 and into the opening 27, permitting pivotal movement of the table top 12, middle leg 18 and brace 20 to the folded position. As shown in FIGS. 4 and 5, the folded position is advantageously compact. This, coupled with a lightweight construction, makes the display table easy to set up, take down and move.

The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A display table movable between a standing position and a folded position comprising, in combination:

a back;

a table to pivotable with respect to the back about a first axis, the table top comprising projections which define a downwardly opening channel extending away from an underside of the table top;

a middle leg pivotable with respect to the back about a second axis generally perpendicular to the first axis; and a brace which engages the middle leg, does not engage the table top in the standing position and which is pivotable with respect to the back;

wherein at the standing position the middle leg is positioned in the channel of the table top and the projections resist movement of the middle leg.

2. The display table of claim 1 wherein the middle leg has a left side and a right side opposite the left side and the projections engage both sides of the middle leg.

3. The display table of claim 1 the brace is pivotable about a third axis remote from and generally parallel to the second axis.

* * * * *